US010115337B2

(12) United States Patent
Kim et al.

(10) Patent No.: US 10,115,337 B2
(45) Date of Patent: Oct. 30, 2018

(54) DISPLAY DEVICE

(71) Applicant: Samsung Display Co., Ltd., Yongin-si, Gyeonggi-do (KR)

(72) Inventors: Tae Joon Kim, Yongin-si (KR); Sung Eun Kim, Yongin-si (KR); Min Jong Hong, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 111 days.

(21) Appl. No.: 14/963,528

(22) Filed: Dec. 9, 2015

(65) Prior Publication Data

US 2016/0321992 A1 Nov. 3, 2016

(30) Foreign Application Priority Data

Apr. 29, 2015 (KR) ..... 10-2015-0060608

(51) Int. Cl.
*G09G 3/3258* (2016.01)
*G09G 3/3225* (2016.01)

(52) U.S. Cl.
CPC ..... *G09G 3/3225* (2013.01); *G09G 2300/043* (2013.01); *G09G 2300/0413* (2013.01); *G09G 2300/0426* (2013.01); *G09G 2330/06* (2013.01); *G09G 2330/08* (2013.01)

(58) Field of Classification Search
CPC ..... G09G 3/3258; G09G 2300/0413; G09G 2300/0426; G09G 2300/043; G09G 2320/0233; G09G 3/3225; G09G 2330/06; G09G 2330/08
See application file for complete search history.

(56) References Cited

U.S. PATENT DOCUMENTS 6,545,653 B1 * 4/2003 Takahara ..... G02F 1/1334 345/100
2006/0017672 A1 * 1/2006 Aoki ..... G09G 3/3233 345/77
2006/0119757 A1 * 6/2006 Tsao ..... G02F 1/136204 349/40
2006/0215104 A1 * 9/2006 Jung ..... G02F 1/1341 349/153
2007/0216614 A1 * 9/2007 Nam ..... G09G 3/30 345/77

(Continued)

FOREIGN PATENT DOCUMENTS

KR 10-2002-0009414 2/2002
KR 10-2007-0028629 3/2007

(Continued)

*Primary Examiner* — Md Saiful A Siddiqui
(74) *Attorney, Agent, or Firm* — Lewis Roca Rothgerber Christie LLP

(57) ABSTRACT

A display device includes a plurality of signal lines formed in a display area, a pixel array connected to the plurality of signal lines and including a plurality of pixels arranged in a matrix, a scan driving circuit and a data driving circuit formed in a non-display area and electrically connected to the plurality of signal lines, and a dummy pattern formed in the non-display area in a position adjacent to the pixel array along an outer boundary of the pixel array. The dummy pattern is formed to be parallel to a first pixel in a position spaced apart from the first pixel located at an edge of the pixel array in the non-display area by a predetermined distance.

9 Claims, 8 Drawing Sheets

(56) References Cited

U.S. PATENT DOCUMENTS

| | | | | |
|---|---|---|---|---|
| 2008/0266282 | A1* | 10/2008 | Lee | G02F 1/136286 345/211 |
| 2009/0267059 | A1* | 10/2009 | Park | H01L 27/3223 257/40 |
| 2010/0072482 | A1* | 3/2010 | Eom | H01L 27/3276 257/72 |
| 2010/0097538 | A1* | 4/2010 | Ota | G02F 1/136204 349/48 |
| 2013/0148050 | A1* | 6/2013 | Kwon | G02F 1/136204 349/43 |
| 2013/0242215 | A1* | 9/2013 | Chang | G02F 1/136204 349/41 |
| 2014/0001966 | A1* | 1/2014 | Cho | H05B 37/00 315/161 |
| 2014/0183481 | A1* | 7/2014 | Lee | H01L 27/3213 257/40 |
| 2016/0035811 | A1* | 2/2016 | Choi | H01L 51/5221 257/72 |

FOREIGN PATENT DOCUMENTS

| | | |
|---|---|---|
| KR | 10-2009-0048742 | 5/2009 |
| KR | 10-2012-0096256 | 8/2012 |
| KR | 10-1283365 | 7/2013 |

* cited by examiner

DISPLAY DEVICE

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57.

This application claims priority to, and the benefit of, Korean Patent Application No. 10-2015-0060608 filed in the Korean Intellectual Property Office on Apr. 29, 2015, the entire contents of which are incorporated herein by reference.

BACKGROUND

Field

The present disclosure relates to a display device which prevents an outer boundary region of a display panel from being deteriorated.

Description of the Related Technology

In a display area of a display device, a plurality of signal lines, and a plurality of pixels connected to the plurality of signal lines are disposed. The plurality of signal lines includes a scan line which transmits a scan signal, a data line which transmits a data signal, and a driving voltage line which transmits a driving voltage ELVDD. The scan line is generally formed to be substantially parallel to a row direction, and the data line and the driving voltage line are generally formed to be substantially parallel to a column direction.

The plurality of scan lines and the plurality of data lines are connected to a scan driving circuit and a data driving circuit in a non-display area outside the display area, respectively, to be applied with a scan signal and a data signal, respectively. In the non-display area, a plurality of data pad units which is electrically connected to output terminals of the plurality of data driving circuits may be arranged along the row direction and a data fan out unit may be provided for each data pad unit to connect the plurality of data pad units and the plurality of data lines.

Each data pad unit typically includes a dummy pad to transmit a voltage signal, at an outermost portion. The plurality of driving voltage lines is connected to voltage wiring lines which intersect the data fan out units while being insulated from the plurality of data fan out units, and a plurality of voltage applying lines which connects the dummy pad and the voltage wiring lines is typically located between the dummy pad and the voltage wiring lines.

In a display device as described above, pattern densities for every pixel in an internal region and an outer boundary region of a pixel array are generally different from each other and patterns in a visual optical influence range (optical influence range) affect the exposure phenomenon during an exposure process (such as for example photolithography), so that a pattern density in the region may vary. Further, since the pixel array pattern density is non-uniform, a critical dimension deviation of a target pattern is also non-uniform.

The above information disclosed in this Background section is only for enhancement of understanding of the background of the invention and therefore it may contain information that does not form the prior art that is already known in this country to a person of ordinary skill in the art.

SUMMARY OF CERTAIN INVENTIVE ASPECTS

The present disclosure has been made in an effort to provide a display device which improves screen uniformity by preventing a dark spot or disconnection of a wiring line of an outer boundary pixel due to different pattern densities in the inside and the outer boundary of the pixel array of the display device.

One embodiment provides a display device including a plurality of signal lines formed in a display area, a pixel array connected to the plurality of signals, the pixel array including a plurality of pixels, a scan driving circuit and a data driving circuit located in a non-display area and electrically connected to the plurality of signal lines, and a dummy pattern formed in the non-display area and in a position adjacent to the pixel array along an outer boundary of the pixel array.

The dummy pattern may be formed to be parallel to a pattern of a first pixel in a position spaced apart from the first pixel located at an edge of the pixel array in the non-display area by a predetermined distance.

The predetermined distance may be the same as a distance between pixel patterns adjacent to each other in two pairs of adjacent pixels.

Further, a thickness of the dummy pattern may be the same as a thickness of the adjacent pixel patterns in the two pairs of pixels.

The dummy pattern may include a first dummy pattern formed at an outer boundary region between the pixel array and the scan driving circuit, and a second dummy pattern formed at an outer boundary between the pixel array and the data driving circuit.

The first dummy pattern and the second dummy pattern may be formed on the same layer or the first dummy pattern and the second dummy pattern may be formed on different layers to be electrically connected to each other in the form of a bridge.

The first dummy pattern and the second dummy pattern may be formed in any one of an active layer, a gate layer, and a data metal layer included in the organic light emitting device.

According to an embodiment, both ends of a wiring line included in the dummy pattern may be connected to a ground wiring line or a power wiring line to be used as a static electricity shielding circuit. A static electricity diode circuit may be connected to a wiring line included in the dummy pattern.

As described above, according to various embodiments, the dummy pattern is formed in an outer boundary region of a pixel array to uniformize pattern densities in the pixel array of the display device and an outer boundary thereof and solving a stain phenomenon and disconnection problem of a wiring line of an outer boundary pixel unit, thereby improving screen uniformity.

DETAILED DESCRIPTION OF CERTAIN INVENTIVE EMBODIMENTS

Figure 1:
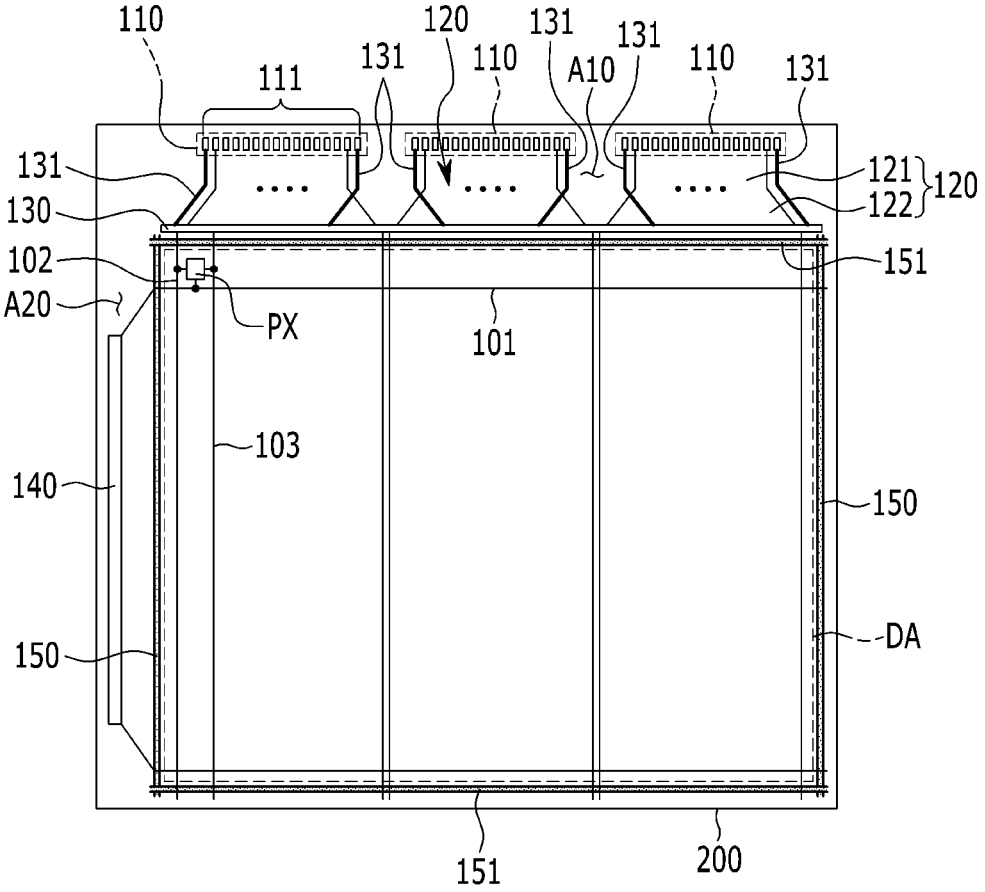
FIG. 1 is a schematic diagram of a display device according to an embodiment.

The present disclosure will be described more fully hereinafter with reference to the accompanying drawings, in which certain embodiments are shown. As those skilled in the art would realize, the described embodiments may be modified in various ways, without departing from the spirit or scope of the present invention.

In the drawings, the thickness of layers, films, panels, regions, etc., may be exaggerated for clarity. Like reference numerals generally designate like elements throughout the specification. It will be understood that when an element such as a layer, film, region, or substrate is referred to as being "on" another element, it can be directly on the other element, or intervening elements may also be present. In contrast, when an element is referred to as being "directly on" another element, there are no intervening elements present.

In the specification, unless explicitly described to the contrary, the word "comprise" and variations such as "comprises" or "comprising", will be understood to imply the inclusion of stated elements but not the exclusion of any other elements. A size and a thickness of a component illustrated in the drawings are arbitrarily illustrated for the convenience of description, so that the disclosure is not limited to the illustrated size and thickness.

FIG. 1 is a schematic diagram of a display device according to an embodiment.

Referring to FIG. 1, a display device according to an embodiment, for example, is an organic light emitting device and includes a display area (DA) and a non-display area outside the display area (DA). In the display area (DA), a plurality of signal lines and a plurality of pixels PX, which is connected to the plurality of signal lines, are formed. The plurality of pixels may be arranged substantially in a matrix. The arrangement of the plurality of pixels PX is referred to as a 'pixel array'.

The plurality of signal lines includes a scan line 101 which transmits a scan signal, a data line 102 which transmits a data signal, and a driving voltage line 103 which transmits a driving voltage (ELVDD). The scan line 101 is formed to be substantially parallel to a row direction and the data line 102 and the driving voltage line 103 are formed to be substantially parallel to a column direction.

Even though pixels which configure a pixel array are not illustrated, the pixels may include a switching thin film transistor, a driving thin film transistor, a capacitor, and an organic light emitting diode (OLED) and if necessary, a separate thin film transistor and a separate capacitor may be added. Further, adjacent pixels at left and right sides may be configured to be bilaterally symmetrical to each other, but the pixel structure is not limited thereto.

The non-display area includes a first area A10 and a second area A20 which are divided along a horizontal direction and a vertical direction with respect to a pixel area.

The first area A10 is a non-display area which is located in a horizontal direction at an outer boundary of the pixel area and in the first area A10, a data pad unit 110 which is electrically connected to output terminals of a data driving circuit (not illustrated) is formed. The data driving circuit may be mounted on a separate semiconductor chip package, such as for example a chip on film, or may be mounted directly on the first area A10. The data pad unit 110 includes a plurality of data pads 111 and a plurality of data lines 102.

A data fan out unit 120, which connects the plurality of data pads 111 and the plurality of data lines 102, is formed between the plurality of data pads 111 and the plurality of data lines 102. The data fan out unit 120 transmits an analog data signal, which is output from the data driving circuit (not illustrated), to the plurality of data lines 102. The data fan out unit 120 may include a straight portion 121, which is in contact with the plurality of data pads 111 and is straightly formed, and an oblique portion 122, which is in contact with the plurality of data lines 102 and is obliquely formed.

In the first area A10, a plurality of data pad units 110 and a plurality of data fan out units 120 are provided. The plurality of data pad units 110 and the plurality of data fan out units 120 are arranged along a row direction. Further, a voltage wiring line 130 is formed on the plurality of data fan out units 120 to intersect the data fan out unit. The voltage wiring line 130 is a single wiring line, formed to be parallel to the row direction and is connected to the plurality of driving voltage lines 103.

A voltage applying line 131, which connects the data pad unit 110 and the voltage wiring line 130, is formed therebetween. The voltage wiring line 130 and the voltage applying line 131 are insulated from the plurality of data fan out units 120 by an insulating layer which is not illustrated. The voltage applying line 131 serves to transmit a driving voltage (ELVDD) signal output from the data driving circuit to the voltage wiring line 130 and the plurality of driving voltage lines 103.

The second area A20 is a non-display area which is located in a vertical direction at an outer boundary of the pixel area and in the second area A20, a scan pad unit 140, which is electrically connected to output terminals of a scan driving circuit (not illustrated), is formed. The scan driving circuit may be mounted on a separate semiconductor chip package, such as for example a chip on film, or may be mounted directly on the second area A20. The plurality of scan lines 101 expands to the scan pad unit 140 to be connected to the scan pad unit 140 and is applied with a scan signal output from the scan driving circuit.

In FIG. 1, even though an example in which the scan pad unit 140 is formed in the second area A20 which is in contact with a left side of the display area DA is illustrated, the scan pad unit 140 may be formed in the first area A10 in other embodiments. The non-display area may also further include a third area which is in contact with a right side of the display area DA and the scan pad unit 140 may be formed in both the second area A20 and the third area.

Further, in at least one of the first area A10 and the second area A20 which are the non-display areas, dummy wiring lines 150 and 151 (hereinafter, referred to as a "dummy patterns") of a dummy pattern which is adjacent to an outermost pattern of the pixel array are formed. The dummy patterns 150 and 151 may be configured by a single pattern or two or more or a plurality of patterns, and may be formed to be parallel to the outermost pattern of the pixel array with a predetermined distance therefrom.

Further, even though the dummy pattern is not illustrated, the dummy patterns are simultaneously formed in the first area A10 and the second area A20 and may be connected to each other using a bridge wiring connection method. Further, a wiring line of the dummy pattern is connected to a ground wiring line GROUND or power lines ELVDD or ELVSS to be used as a static electricity shielding circuit.

Hereinafter, a configuration of a display device will be described in more detail with reference to FIGS. 2 to 4.

Figures 2A, 2B:
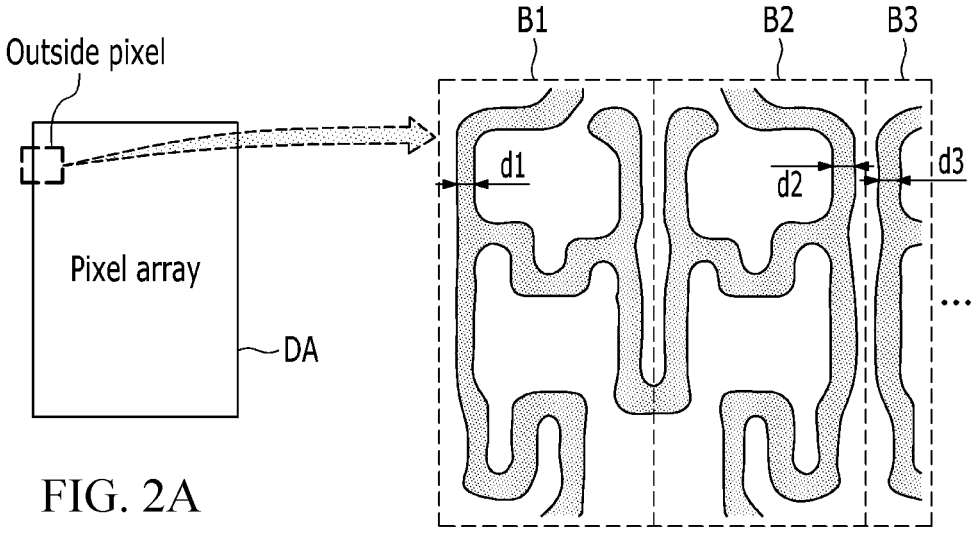
FIG. 2A and FIG. 2B illustrate a prior art display device to compare with an embodiment.

FIG. 2A and FIG. 2B show a partially enlarged view of a normal display device which is compared with an embodiment.

Referring to FIG. 2A and FIG. 2B, in a pixel array of the normal display device, there is a significant deviation between a thickness $d_1$ of an outside pattern of a first pixel $B_1$ and a thickness $d_2$ or $d_3$ of a pattern in a second pixel $B_2$ or a third pixel $B_3$ corresponding to the outside pattern of the first pixel $B_1$. For example, referring to the pixel array illustrated in FIG. 2A and FIG. 2B, when the thickness $d_2$ or $d_3$ of the pattern formed at an outside in the second pixel $B_2$ or the third pixel $B_3$ is about 1.7 μm, the thickness $d_1$ of a pattern formed in a position corresponding to the outside of first pixel $B_1$ is about 1.1 μm, so that it is confirmed that the thickness is reduced by about 0.6 μm and an error is approximately 30%.

In this case, the pattern of the pixel illustrated in FIG. 2A and FIG. 2B may be a semiconductor layer of an organic light emitting device, for example.

In a normal display device illustrated in FIG. 2A and FIG. 2B, pattern densities for every pixel in an internal region and an outer boundary region are different from each other and patterns in a visual influence range (optical influence range) affect the exposure phenomenon during an exposure process (photolithography), so that a pattern density in the region may vary. Since the pixel array pattern density is non-uniform, a critical dimension deviation of a target pattern is also non-uniform.

Therefore, when a dummy pixel is additionally disposed in a space of about 30 μm or larger in an outer boundary region of the pixel array, it is effective to make the pattern density of the outer boundary region be the same as the density in the pixel array and a critical dimension deviation between patterns may be minimized.

As an example for solving the above-mentioned problem, a method of designing a dummy pixel at an outer boundary region of the pixel array by a plurality of sub-pixels has been suggested. However, according to this method, the critical dimension deviation in the display area DA may be presented, but an area of the non-display area is undesirably increased. For example, when the dummy pixel is additionally formed in the space of approximately 30 μm or larger at the outer boundary of the pixel array, it is effective to uniformize the pattern density in the pixel array. However, in a small or medium size OLED product, the dummy pixel is not designed. Therefore, when there is a dummy pixel, the non-display area is increased or a space for a driving circuit design is reduced, which causes restriction in designing a high resolution product.

Therefore, the present disclosure suggests a method which forms a dummy pattern in an outer boundary side of a display area DA where the pixel array is formed to uniformize the pattern density of the pixel array of the display area.

Figures 3A, 3B:
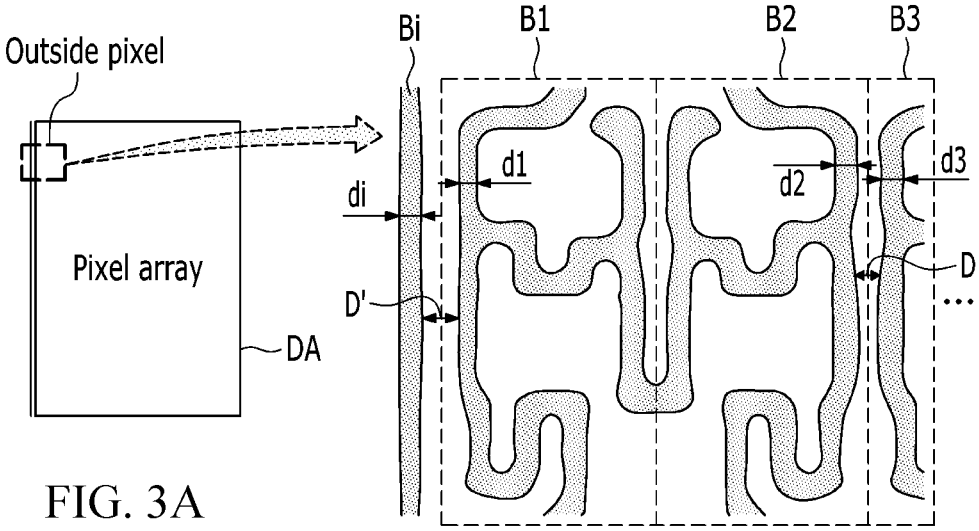
FIG. 3A and FIG. 3B illustrate a display device according to an embodiment.

FIG. 3A and FIG. 3B illustrate an organic light emitting device according to an embodiment.

In the organic light emitting device illustrated in FIG. 3A, when an outer boundary region B including a part of the display area DA in which a plurality of signal lines and a plurality of pixels are formed and a part of the non-display area is exaggerated, a patterning structure as illustrated in FIG. 3B may be confirmed.

Referring to FIG. 3B, the pixel array formed in the display area DA is formed such that a first pixel $B_1$ and a second pixel $B_2$ are bilaterally symmetrical to each other. Further, even though not illustrated, in the display area DA, a third pixel $B_3$ and a fourth pixel $B_4$ which are adjacent to the second pixel B2 are bilaterally symmetrical to each other and pixel arrays having the same patterns which are bilaterally symmetrical to each other are repeatedly formed. That is, two adjacent pixels form a pair of pixel arrays and a plurality of pairs is formed to be repeatedly arranged in the display area DA.

In this case, for better comprehension and ease of description, it is assumed that the first pixel $B_1$ indicates any one of a plurality of pixels which is located at an edge of the display area DA.

Further, a dummy pattern $B_i$ is formed in the non-display area which is an outer boundary region of the display area DA where the pixel array is formed.

The pattern $B_i$ is a single pattern and is formed in a vertical direction to be parallel to the outermost pattern of the first pixel $B_1$ at a position which is spaced apart from the first pixel $B_1$ in the second area A20 of the non-display area by a predetermined distance D'.

The predetermined distance D' is configured to be the same as a wiring distance D including a reference line between the second pixel $B_2$ and the third pixel $B_3$ along a reference line formed by a pixel array pair (for example, first pixel and second pixel) which is adjacent to the dummy pattern and a next pixel array pair which is adjacent to the pixel array pair (the first pixel and the second pixel) in a vertical direction.

Further, a thickness ($d_i$) of the dummy pattern wiring line may also be configured to be the same as the wiring thickness $d_2$ or $d_3$ of the second pixel $B_2$ or third pixel $B_3$ with respect to the reference line between the pixels. In some cases, in consideration of the pattern density effect, in order to stably pattern the dummy pattern wiring line, the dummy pattern wiring line may be designed to have the thickness $d_i$ which is larger than the wiring thickness $d_2$ and $d_3$ of the second pixel $B_2$ or the third pixel $B_3$.

As described above, it is confirmed that due to the dummy pattern $B_i$ which is formed in the second area A20, which is a non-display area, in the vertical direction, the thickness $d_1$ of the pattern formed at the outer boundary region of the first pixel $B_1$ has a predetermined range of error as compared with the thickness $d_2$ or $d_3$ of the pattern formed in a corresponding position of the second pixel $B_2$ or the third pixel $B_3$.

For example, referring to the pixel array illustrated in FIG. 3B, when the thickness $d_2$ and $d_3$ of the pattern formed at the outer boundary side in the second pixel $B_2$ or the third pixel $B_3$ is about 1.7 μm, the thickness $d_1$ of the pattern formed in a corresponding position at the outer boundary side in the first pixel $B_1$ is about 1.65 μm which is reduced by about 0.05 μm and an error is about 3% or smaller. The exposure process is mostly affected by the presence of the first adjacent pattern which is the most adjacent between the pixel array patterns, so that the critical dimension deviation of the pattern may be reduced only by forming the dummy pattern in accordance with the pattern density of the most adjacent pattern.

Figure 4A:
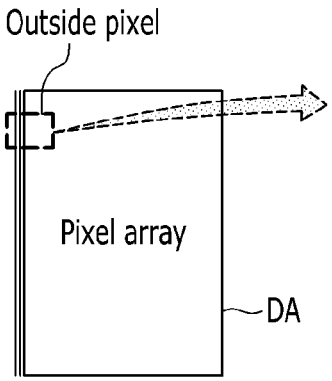
FIG. 4A and FIG. 4B illustrate of a display device according to another embodiment.
Figure 4B:
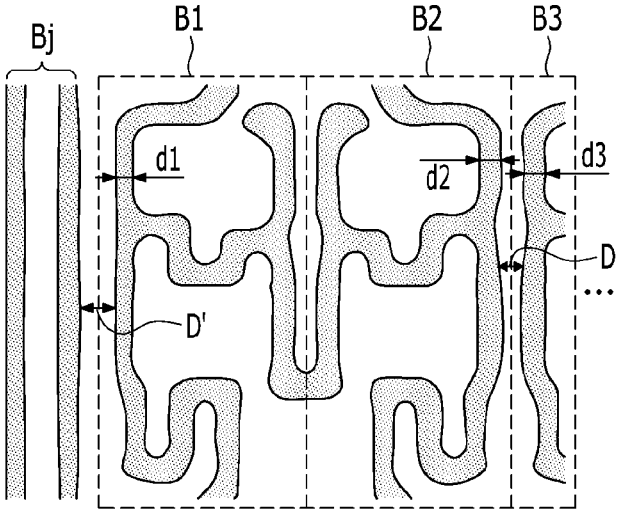

FIG. 4A and FIG. 4B illustrate an organic light emitting device according to another embodiment.

The pixel array formed in the display area DA illustrated in FIG. 4A is formed such that as illustrated in FIG. 4B, the first pixel $B_1$ and the second pixel $B_2$ are bilaterally symmetrical to each other and even though not illustrated, the third pixel $B_3$ and the fourth pixel $B_4$ which are adjacent to the second pixel B2 are formed to be bilaterally symmetrical to each other. As described above, pixels having the same bilateral-symmetric pattern are repeatedly formed to configure the pixel array.

In the second area A20 in the non-display area which is adjacent to the display area DA, a plurality of dummy patterns $B_j$ according to another embodiment may be formed. Each dummy pattern which configures a plurality of dummy patterns $B_j$ may be located to be parallel to a pattern located in an outer boundary region of the first pixel $B_1$.

A dummy pattern $B_{j1}$ which is close to the first pixel $B_1$ among the plurality of dummy patterns $B_j$ is formed in a position spaced apart from the first pixel $B_1$ by a predetermined distance D' and the predetermined distance D' may be configured to be the same as a distance D between the second pixel $B_2$ and the third pixel $B_3$ including a reference line of the pixel array. Further, the distance between the dummy patterns which configure the plurality of dummy patterns $B_j$ may be implemented in the same range as the predetermined distance D'.

Similarly, a width of the dummy pattern wiring line may be the same as a width W of a wiring line of the second pixel $B_2$ or the third pixel $B_3$ or may be designed to be larger than the width W of the wiring line of the second pixel $B_2$ or the third pixel $B_3$ in consideration of the pattern density effect.

As described above, it is confirmed that due to the plurality of dummy patterns $B_j$, the thickness $d_1$ of the pattern formed at the outer boundary region of the first pixel $B_1$ has a predetermined range of error as compared with the thickness $d_2$ or $d_3$ of the pattern in a corresponding position of the second pixel $B_2$ or the third pixel $B_3$.

For example, referring to the pixel array illustrated in FIGS. 4A and 4B, when the thickness $d_2$ and $d_3$ of the pattern formed at the outer boundary side in the second pixel $B_2$ or the third pixel $B_3$ is about 1.7 μm, the thickness $d_1$ of the pattern formed in a corresponding position at the outer boundary side in the first pixel $B_1$ is about 1.63 μm which is reduced by about 0.07 μm and an error is about 4% or smaller.

Therefore, according to the embodiment, the dummy pattern is formed at the outer boundary of the display area DA in accordance with the pixel array pattern, so that a degree of nonuniform pattern threshold deviation in the display area DA and at the outer boundary of the display area DA may be reduced. Further, as compared with the normal organic light emitting device illustrated in FIGS. 2A and 2B, a plurality of dummy pixels is additionally formed in the non-display area in order to uniformize the pattern density, thereby preventing the non-display area from being increased.

Figure 5:
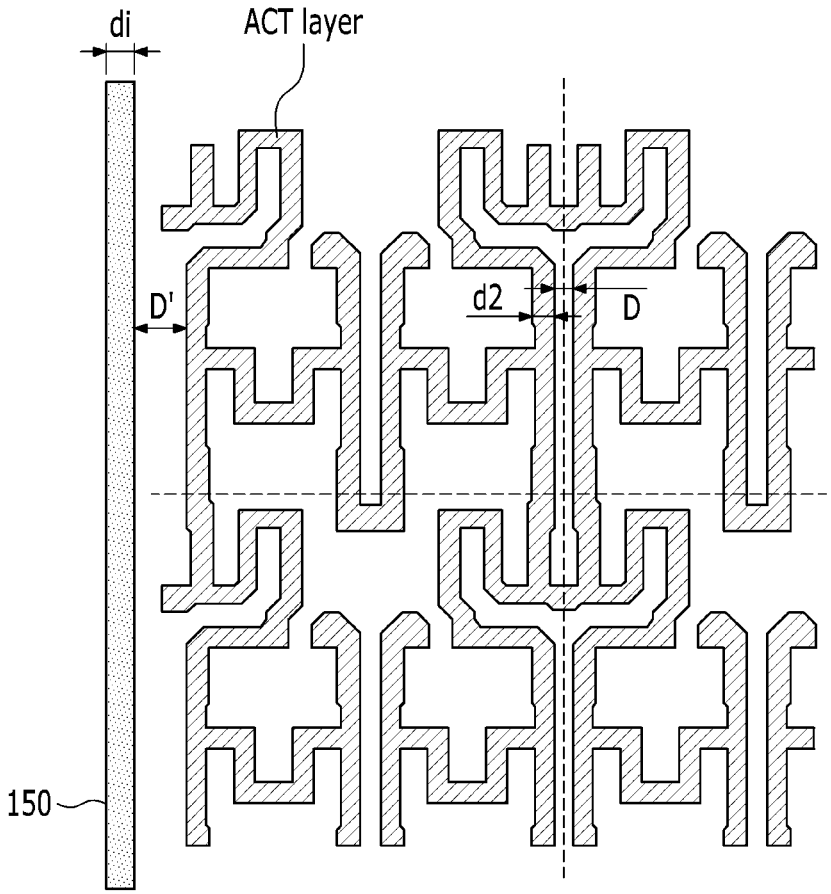
FIGS. 5 to 7 are views illustrating an example in which a dummy pattern of a display device according to another embodiment is formed.
Figure 6:
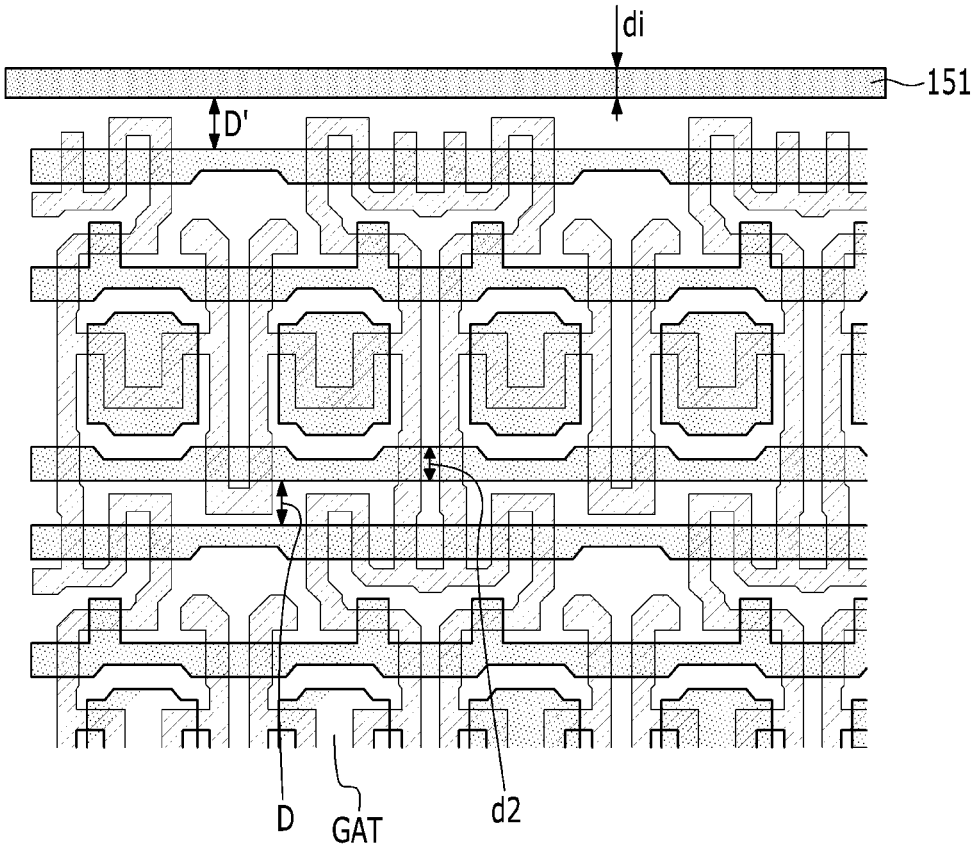
Figure 7:
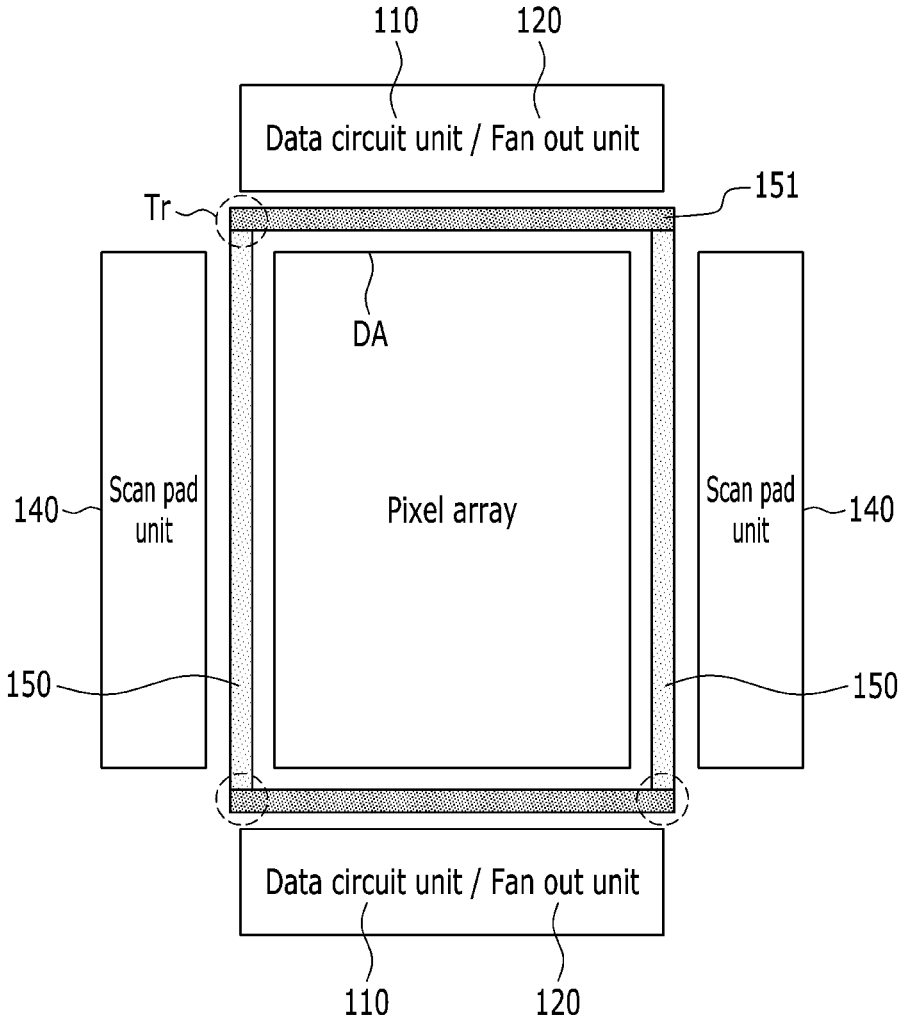

FIGS. 5 to 7 are views illustrating an example in which a dummy pattern of an organic light emitting device according to another embodiment is formed.

Referring to FIG. 5, in an organic light emitting device according to another embodiment, a vertical dummy pattern 150 which is adjacent to the pixel array is added to an active layer (ACT layer) of an outer boundary region of the pixel array. An example of the dummy pattern in the active layer may be an additional active wiring line.

Even though not illustrated, the vertical dummy pattern is formed in a position which is adjacent to the first pixel located at the outermost part of the pixel array, between the display area DA where the pixel array is formed and a driving circuit formed in a non-display area.

Referring to FIG. 6, a horizontal dummy pattern 151 which is adjacent to the pixel array is added to a gate layer (GAT layer) of an outer boundary region of the pixel array of the organic light emitting display device. An example of the dummy pattern in the gate layer may be an additional gate wiring line.

That is, according to another embodiment, like an additional active wiring line or an additional gate wiring line, a wiring line type of dummy pattern is added to every necessary layer in the organic light emitting device, thereby increasing a correction effect of critical dimension deviation of the pixel array pattern. Further, even though not illustrated in FIG. 5, the dummy pattern for every layer may be configured by a signal wiring line or a plurality of wiring lines.

Referring to FIG. 7, the dummy patterns 150 and 151 which are formed in a vertical direction and a horizontal direction are connected by a single layer, at the outer boundary of the display area DA where the pixel array is formed, to enclose the outer boundary of the pixel array. For example, the additional active wiring line and the additional gate wiring line are connected by the single layer to be enclosed by the vertical and horizontal dummy patterns 150 and 151 along the entire outer boundary of the pixel array. In this case, a region Tr where the additional active wiring line and the additional gate wiring line overlap may be formed using a transistor.

As illustrated in FIG. 7, the dummy pattern which is formed to enclose the entire outer boundary of the pixel array is formed, that is, the vertical dummy pattern 150 is formed between the outside of the pixel array region and the inside of the scan pad unit 140. In contrast, the horizontal dummy pattern 151 is formed between the outside of the pixel array region and the inside of the data circuit unit 110/the data fan out unit 120.

Figure 8:
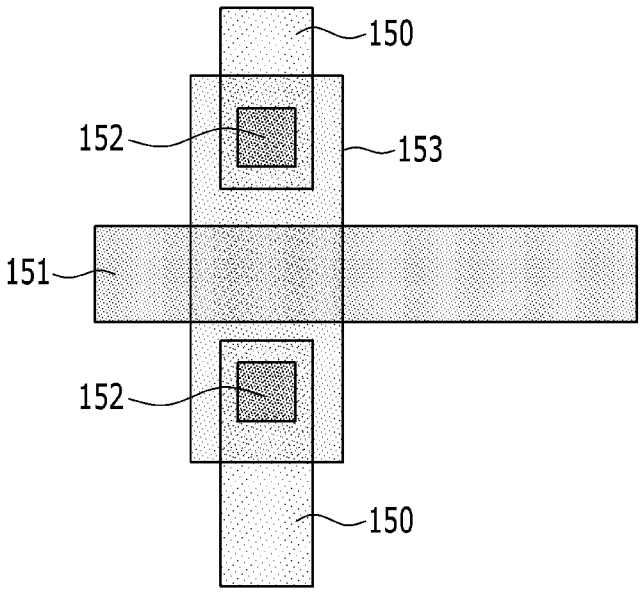
FIG. 8 is a view illustrating another example in which a dummy pattern of a display device according to another embodiment is formed.

FIG. 8 is a view illustrating another example in which a dummy pattern of an organic light emitting device according to another embodiment is formed.

Referring to FIG. 8, a region where the vertical dummy pattern 150 and the horizontal dummy pattern 151 overlap in the outer boundary region of the pixel array is configured to have a bridge shape so that the dummy pattern may enclose the entire outer boundary of the pixel array.

Specifically, the additional active wiring line is configured by a dotted line wiring line and is electrically connected to dummy patterns 150 and 151 which are formed on different layers using a contact hole (CNT) 152 and a data metal element 153 which are formed in the additional active wiring line. Further, as a layer in which a dummy pattern is formed, an active layer, a gate layer, or a data metal layer may be exemplified.

Both ends of the dummy pattern, which is formed to enclose the outer boundary of the pixel array region in the form of a bridge, are connected to the ground wiring line or a power wiring line ELVDD or ELVSS to be used as a static electricity shielding circuit. For example, when the wiring line of the dummy pattern is connected to the ELVDD power source, the wiring line is repeatedly connected to every pixel unit to help configure an ELVDD power mesh, thereby reducing the ELVDD wire resistance and uniformizing a power voltage.

Further, as illustrated in FIG. 7, even though a transistor is formed at a connected part between wiring lines, in the dummy pattern in accordance with the normal wiring line connection, both ends of the wiring node are tied to be a ground to reduce influence of current movement, thereby achieving a static electricity preventing function.

Even though not illustrated, a static electricity diode circuit is connected to a wiring line which configures a dummy pattern to use the dummy pattern as a part of a static electricity preventing circuit.

When an additional wiring line is designed according to another embodiment, the wiring line may be configured by a thin wiring pattern of approximately 1 to 1.5 μm and various wiring combinations may also be used. The wiring pattern is designed to be a scattering bar that a dummy pattern is patterned by a mask but does not have a pattern after the exposure process, to compensate for an optical density to correct a critical dimension deviation of the pattern.

Alternatively, according to another embodiment, separately from the dummy pattern at an outer boundary of the pixel array, an additional dummy pattern may be configured by repeated patterns such as a dotted line or a simple quadrangle.

While this disclosure has been described in connection with certain embodiments, it is to be understood that the invention is not limited to the disclosed embodiments, but, on the contrary, is intended to cover various modifications and equivalent arrangements included within the spirit and scope of the appended claims.

What is claimed is:

1. A display device comprising:

a plurality of signal lines formed in a display area;

a pixel array connected to the plurality of signal lines, the pixel array including a plurality of pixels each including a pixel pattern;

a scan driving circuit and a data driving circuit located in a non-display area and electrically connected to the plurality of signal lines; and a dummy wiring line of a continuous thickness formed in the non-display area in a position adjacent to the pixel array, the dummy wiring line extending continuously along an entire periphery of the pixel array and having a shape of a closed loop around the pixel array, and wherein the dummy wiring line is spaced apart from the periphery of the pixel array by a predetermined distance, wherein the dummy wiring line comprises:

a first dummy wiring line extending along a first side of the pixel array in a first direction;

a second dummy wiring line extending along a second side of the pixel array parallel to the first side;

a third dummy wiring line extending along a third side of the pixel array in a second direction perpendicular to the first direction; and a fourth dummy wiring line extending along a fourth side of the pixel array parallel to the third side, wherein at least one of the first and second dummy wiring lines is at an outer boundary region between the pixel array and the scan driving circuit, wherein at least one of the third and fourth dummy wiring lines is at an outer boundary between the pixel array and the data driving circuit, and wherein the first dummy wiring line is in a different layer from the third dummy wiring line at one end of the third dummy wiring line via a contact hole and a bridge.

2. The display device of claim 1, wherein:

the predetermined distance is the same as a distance between two adjacent pixel patterns.

3. The display device of claim 1, wherein:

a thickness of the dummy wiring line is the same as a thickness of the pixel patterns.

4. The display device of claim 1, wherein:

the first and second dummy wiring lines are disposed at a same layer as each other and at a different layer from the third and fourth dummy wiring lines and electrically connected to the third and fourth dummy wiring lines via a bridge, respectively.

5. The display device of claim 4, wherein:

the first and second dummy wiring lines are formed in an active layer, and the third and fourth dummy wiring lines are formed in a gate layer which is a different layer from the active layer.

6. The display device of claim 5, wherein:

the second dummy wiring lines is electrically connected to the fourth dummy wiring line via a contact hole and a bridge.

7. The display device of claim 1, wherein:

the first and second dummy wiring lines are formed in any one of an active layer, and a data metal layer that are different layers from each other and are included in an organic light emitting device.

8. The display device of claim 1, wherein:

both ends of a wiring line included in the dummy wiring line are connected to a ground wiring line or a power wiring line to be used as a static electricity shielding circuit.

9. The display device of claim 1, wherein:

a static electricity diode circuit is connected to the dummy wiring line.

* * * * *